United States Patent [19]

Bitko

[11] 3,978,301

[45] Aug. 31, 1976

[54] MERCURY TILT SWITCH

[75] Inventor: Sheldon S. Bitko, East Brunswick, N.J.

[73] Assignee: Fifth Dimension Inc., Princeton, N.J.

[22] Filed: July 31, 1975

[21] Appl. No.: 600,922

[52] U.S. Cl. ..... 200/220; 200/222; 335/54

[51] Int. Cl.[2] ..... H01H 29/22

[58] Field of Search ..... 335/54, 58, 57, 49; 200/220, 222, 182, 231, 235, 236, 61.47, 61.52

[56] References Cited

UNITED STATES PATENTS

| | | | |
|---|---|---|---|
| 2,150,379 | 3/1939 | Kerschbaum | 200/222 |
| 3,369,094 | 2/1968 | Langberg et al. | 335/57 |
| 3,646,490 | 2/1972 | Bitko | 335/58 |

*Primary Examiner*—Harold Broome

*Attorney, Agent, or Firm*—Burns, Doane, Swecker & Mathis

[57] ABSTRACT

A tilt switch formed of a cap and header welded together at their rims to form an enclosure, and assuming the rims to be horizontal, on electrode passing vertically through one of the cap and header via an insulator. The inside of the enclosure and the electrode are mercury wettable and only enough mercury is provided to wet the inner surface of the enclosure with a thin layer of mercury, plus a small pool of mercury into which the electrode extends while the electrode is vertical or within a predetermined small conical angle from the vertical, the pool of mercury responding to gravity to bare the electrode when the predetermined conical angle is exceeded by tilting the switch.

5 Claims, 1 Drawing Figure

MERCURY TILT SWITCH

BACKGROUND OF THE INVENTION

It is known (Bitko, U.S. Pat. No. 3,697,906, issued Oct. 10, 1972) to provide mercury relays and switches employing armatures, in which a metallic enclosure composed of a cap and header welded at their rims form an enclosure and in which the armature is a spiral spring having its center point free to move and its outer perimeter constrained. The inner surface of the enclosure and the armature are mercury wettable. An electrode, mercury wettable at its inner end, extends through one of the cap and header via an insulator into promimity to the center of the armature and is itself magnetic. Application of magnetic force then causes the central free end of the armature to move into contact with the electrode to complete a circuit between the electrode and the enclosure, the insulator being of non-mercury wettable material, preferably glass. Only enough mercury is inserted into the enclosure to form a thin layer of mercury over the mercury wettable surfaces, but not enough to form a pool of mercury.

Use of the specified quantity of mercury renders the switch operable in any orientation and when subjected to high accelerations, since surface tension forces hold the mercury layer in place, and/or cause it to reform if it is broken. Closure of the contacts causes splatter of mercury, but the splattered mercury rejoins the thin layer.

In accordance with the present invention, which relates to a tilt switch, the general concept of employing only enough mercury to form a thin layer in a mercury wettable enclosure is departed from to the extent that an excess of mercury is added, which forms a small pool in the enclosure, in addition to the thin layer, the small pool representing a localized thickening of the mercury layer, the location of which is determined by the force of gravity.

The electrode extends into the pool of mercury when the electrode is vertical, but also when the electrode departs from the vertical within a solid angle determined by the depth of the pool and the length of the electrode and the shape of the enclosure. The present system requires that a circuit be maintained closed over a predetermined and fixed solid angle in the range of 15° – 30° from the vertical, and open otherwise. The use of the invention is to illuminate the LED of a LED timepiece, i.e. a wristwatch, when the latter is held nearly horizontal for observation by a wearer, the LEDs being otherwise unilluminated.

The depth of the mercury pool, when the electrode is vertical, is very precisely established, in accordance with the present invention, and the pool moves precisely according to the angle of a tilt of the electrode, so that it is possible to establish with considerable precision the solid angle over which switch closure occurs and this angle can be as small or as large as desired within wide limits.

The use of mercury contacts provides extremely low and constant contact resistance, and the capability of passing very small currents, of the order of a few microamperes.

SUMMARY OF THE INVENTION

A mercury tilt switch, closed over a precisely predetermined solid angle of tilt, including an enclosure which is mercury wettable over its interior surface, and includes only enough mercury to form a thin layer of mercury over the interior surface plus enough mercury to form a small pool of mercury subject to movement in response to gravity, and an electrode extending through an insulator into contact with the pool when the electrode is vertical or departs from the vertical by no more than a predetermined solid angle, the tilt switch preferably being fabricated of a cap and a header, welded at their edges, and an electrode and lead through insulation for the electrode.

DETAILED DESCRIPTION OF THE INVENTION

Figure 1:
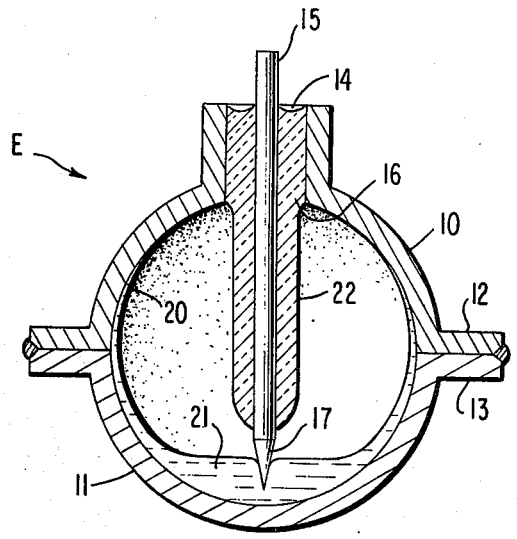
FIG. 1 is a view in vertical section through a tilt switch according to the invention.

Referring to the accompanying drawings, 10 represents a header and 11 a cap. The header 10 and the cap 11 include circular flanges 12 and 13, respectively. The materials of which the cap and header are fabricated are weldable, and the header and cap 10 and 11 are welded together at the flanges 12 and 13 to form a sealed enclosure E.

The header 10 includes an opening 14, through which extends an electrode 15, through a glass seal and insulator 16. The inner end 17 of electrode 15 is left bare and extends to within a small distance of the inner surface of cap 11. The inner surface of the enclosure is mercury wettable. This may best be accomplished by electrolessly plating the inner surface with electroless nickel or other mercury compatible material. The exposed surface of the electrode may be similarly treated, or it may be unwettable, as desired.

Mercury is provided internally of the enclosure E, sufficient to form a thin layer 20 over the entire inner surface, plus enough to form a small pool 21. The electrode end 17 extends into pool 21 when the electrode is vertical or within a predetermined solid angle of being vertical. This angle can be pre-selected in terms of the depth of the pool 21, the geometrical configuration of the cap 11, and the length of the electrode 15, or, more precisely, the distance of the end of the electrode 17 from the nearest point of the cap 11.

There is an advantage in not having the end 17 of the electrode mercury wettable, in that there will then be no thread or filament of mercury extending from the electrode end 17 to the pool 21 during the breaking process. But, allowance can be made for this thread, so that a choice exists, i.e., the electrode end 17 can be wettable or not wettable. The electrode can be coated with glass 22 or other insulator, except at its exposed end 17, to immunize possibility of switch closure due to splashing of mercury.

The horizontal section of the switch is preferably circular (not shown). The vertical configuration of the header can be arcuate spherically, or saucer shaped, or conical with apex directly aligned with the electrode, or flat bottomed over its bottom the important point being that there is sufficient concavity, selected in terms of the quantity of mercury employed to provide the required solid angle of closure.

While mercury is disclosed as the preferred liquid, it is known that addition of small amounts of Caesium, for example, to mercury reduces surface tension of mercury radically. The term "mercury" is to be taken to include mercury with an additive or additives which serve to reduce surface tension. Other fluids than mercury, which are conductive and can wet surfaces and provide thin layers are also substitutable for mercury.

The present switch is also usable to detect acceleration, since the pool will move with respect to the electrode in response to acceleration.

I claim:

1. A mercury tilt switch, consisting of an enclosure having an internal mercury wettable surface, an electrode extending through one wall of said enclosure to a point adjacent to but not touching an inner surface of said enclosure, a quantity of mercury within said enclosure sufficient to wholly coat said internal mercury wettable surface plus enough to form a small pool of said mercury into which said electrode extends while said pool is directly opposed to said electrode and over a predetermined solid angle between said electrode and the surface of said pool, said small pool being positionable by gravity as said enclosure tilts.

2. The claimed apparatus of claim 1, wherein said enclosure consists of a cap and a header welded at their rims.

3. A conductive fluid switch, consisting of an enclosure having an internal surface wettable by said conductive fluid, an electrode extending through one wall of said enclosure to a point adjacent to but not touching an inner surface of said enclosure, a quantity of conductive fluid within said enclosure sufficient to wholly coat said internal surface plus enough to form a small pool of said liquid into which said electrode extends while said pool is directly opposed to said electrode and over a predetermined solid angle between said electrode and the surface of said pool, said pool being orientable by gravity as said enclosure tilts.

4. The combination according to claim 3, wherein said enclosure consists of a cap and header welded together at their rims.

5. The combination according to claim 4, wherein said liquid is mercury plus a few parts of Caesium, to reduce surface tension of said mercury.

* * * * *